US009291007B2

(12) United States Patent
Darbe et al.

(10) Patent No.: US 9,291,007 B2
(45) Date of Patent: Mar. 22, 2016

(54) FLOATING APPARATUS AND METHOD FOR FABRICATING THE APPARATUS

(71) Applicant: HALLIBURTON ENERGY SERVICES, INC., Duncan, OK (US)

(72) Inventors: Robert Phillip Darbe, Duncan, OK (US); Henry Eugene Rogers, Duncan, OK (US); Paul Joseph Jones, Humble, TX (US); Misty Dawn Rowe, New Caney, TX (US); Jeffery Dwane Karcher, Houston, TX (US); Lonnie C Helms, Duncan, OK (US)

(73) Assignee: Halliburton Services, Inc., Houston, TX (US)

( * ) Notice: Subject to any disclaimer, the term of this patent is extended or adjusted under 35 U.S.C. 154(b) by 486 days.

(21) Appl. No.: 13/759,607

(22) Filed: Feb. 5, 2013

(65) Prior Publication Data

US 2014/0216742 A1 Aug. 7, 2014

(51) Int. Cl.

| | |
|---|---|
| ***E21B 17/14*** | (2006.01) |
| ***E21B 33/14*** | (2006.01) |
| ***E21B 21/10*** | (2006.01) |

(52) U.S. Cl.

CPC ..... *E21B 17/14* (2013.01); *E21B 21/10* (2013.01); *E21B 33/14* (2013.01)

(58) Field of Classification Search

CPC ..... E21B 33/14; E21B 17/14

See application file for complete search history.

(56) References Cited

U.S. PATENT DOCUMENTS

| | | | | |
|---|---|---|---|---|
| 3,255,819 | A * | 6/1966 | Scott et al. | 166/292 |
| 3,332,499 | A | 7/1967 | Harris | |
| 3,957,114 | A | 5/1976 | Streich | |
| 4,067,358 | A | 1/1978 | Streich | |
| 4,712,619 | A | 12/1987 | Stepp et al. | |
| 5,450,903 | A | 9/1995 | Budde | |
| 5,472,053 | A | 12/1995 | Sullaway | |
| 5,511,618 | A | 4/1996 | Budde | |
| 5,567,748 | A | 10/1996 | Klein | |
| 5,680,902 | A | 10/1997 | Giroux et al. | |
| 5,690,177 | A | 11/1997 | Budde | |
| 5,697,442 | A | 12/1997 | Baldridge | |
| 5,836,395 | A | 11/1998 | Budde | |
| 5,909,771 | A | 6/1999 | Giroux et al. | |
| 6,328,107 | B1 | 12/2001 | Maus | |
| 7,114,560 | B2 | 10/2006 | Nguyen | |
| 2008/0110625 | A1 | 5/2008 | Arcement | |

FOREIGN PATENT DOCUMENTS

| | | |
|---|---|---|
| CA | 2311362 A1 | 6/1999 |
| CA | 2292663 C | 8/2007 |

(Continued)

OTHER PUBLICATIONS

International Search Report and Written Opinion of the International Searching Authority dated Apr. 22, 2014, filed in corresponding PCT Application No. PCT/US2014/010687.

*Primary Examiner* — David Andrews

(74) *Attorney, Agent, or Firm* — McAfee & Taft, A Professional Organization

(57) ABSTRACT

A floating apparatus for use in a casing string is provided. The apparatus includes an outer sleeve having a valve centrally positioned therein. A cement body is affixed to the check valve and the housing by use of a bonding material.

17 Claims, 2 Drawing Sheets

(56) References Cited

FOREIGN PATENT DOCUMENTS

| | | | |
|---|---|---|---|
| EP | 0255269 | A3 | 2/1989 |
| EP | 0255269 | B1 | 9/1991 |
| EP | 0752047 | B1 | 12/2000 |
| EP | 0986690 | B1 | 2/2003 |
| WO | 9525873 | A1 | 9/1995 |
| WO | 9855729 | A1 | 12/1998 |
| WO | 9927226 | A1 | 6/1999 |

* cited by examiner

FLOATING APPARATUS AND METHOD FOR FABRICATING THE APPARATUS

BACKGROUND OF THE INVENTION

1. Field of the Invention

This invention relates to floating equipment used in cementing operations and to methods of fabricating such equipment. More particularly, this invention relates to an improved floating apparatus that provides for improved reliability to hold differential pressures under a variety of cyclic loading conditions.

2. Description of the Related Art

Typically, after a well for the production of oil and/or gas has been drilled, casing will be lowered into and cemented in the well. The weight of the casing, particularly with deep wells, creates a tremendous amount of stress and strain on the equipment used to lower the casing into the well. In order to minimize that stress, floating equipment, such as, but not limited to, float shoes and/or float collars are used in the casing string. Typical of the float equipment that might be used is the Halliburton Super Seal™ II float collar and the Halliburton Super Seal™ II Float Shoe.

The float equipment typically consists of a valve affixed to the outer casing which allows fluid to flow down through the casing but prevents flow in the opposite direction. Because upward flow is obstructed, a portion of the weight of the casing will float or ride on the well fluid thus reducing the amount of weight carried by the equipment lowering the casing into the well.

Once the casing is installed into the wellbore, cement fluid is commonly pumped from the surface through the casing into the wellbore at the lower end of the casing. The cement is lifted up the annulus with pressure pumping equipment because the weight or density of the cement is generally greater than the weight or density of the displacement fluid pumped behind the cement. After displacement operations are completed, the casing is filled with displacement fluid and cement is located in the annular space between the casing and the wellbore for the purpose of creating annular isolation, at which point the surface pressure is released and the valve holds the cement in place by creating a barrier for holding differential pressure.

The float equipment is typically fabricated by affixing a check valve in an outer sleeve, which is adapted to be threaded directly into a casing string. The valve is affixed by filling the annulus between the valve housing and the outer sleeve with a high compressive strength cement to form a cement body portion. Over a period of time, the cement poured between the valve and the outer sleeve shrinks slightly as it cures. The shrinkage can cause a micro-annulus between the cement body portion and the outer sleeve and between the cement body portion and the valve. Fluid flowing through the casing can flow through the micro-annulus thus eroding the cement body portion and causing a leak. The leakage through the micro-annulus will allow the cement used to cement the casing in place to re-enter the inner diameter of the casing after the cementing job is completed. The cement must be removed by drilling. The leakage will also allow well fluids to contaminate the cement on the outer diameter of the casing, which affects the integrity of the cement and the cementing job.

Additionally, recent events in the industry have increased the focus on performance testing of cementing float equipment. Specifically, API Standard 65-2 and API RP 10F have elevated the performance testing requirements of cementing float equipment. Current float designs are scarcely able to pass the rigorous testing described.

Accordingly, it is important that there be a competent bond between the cement and the valve and between the cement and the casing, which avoids leakage so that the bonds provide the desired hydraulic pressure rating and hold the needed differential pressure. Accordingly, it would be advantageous to improve the bond between the cement and the case and between the cement and the valve.

SUMMARY OF THE INVENTION

In one embodiment of the invention there is provided a floating apparatus for use in a well casing comprising an outer sleeve, a valve, a first bonding material, a second bonding material and a cementitious material. The outer sleeve is configured to be connected to the well casing. The outer sleeve has an outer surface and an inner surface, wherein the inner surface defines a central flow passage. The valve is disposed in the outer sleeve. The valve comprises a valve housing having an interior surface defining a bore in fluid flow communication with the central flow passage and an exterior surface opposing said inner surface of the outer sleeve. The exterior surface and inner surface define an annulus between the valve housing and the outer sleeve. The first bonding material is adhered to and encircles at least a portion of the inner surface of the outer sleeve located in the annulus. The second bonding material is adhered to and encircles at least a portion of the exterior surface of the valve housing located in the annulus. The cementitious material has a first surface and a second surface. The cementitious material is disposed in the annulus with the first surface being bonded to the first bonding material and the second surface being bonded to the second bonding material so that the cementitious material prevents flow through the annulus.

In another embodiment of the invention, there is provided a method of fabricating substantially leakproof floating equipment comprising:

(a) placing a valve inside an outer sleeve, said valve having a housing having an exterior surface and said outer sleeve having an inner surface, said inner surface defining a central flow passage, and said exterior surface of said housing and inner surface of said outer sleeve defining an annulus;

(b) coating said exterior surface of said housing with a first bonding material and said inner surface of said outer sleeve with a second bonding material wherein said coating occurs at least along the portions of said inner surface and said outer surface defining said annulus and wherein said first bonding material and said second bonding material harden after said coating;

(c) placing a cementitious material in said annulus prior to said first bonding material and said second bonding material hardening; and (d) allowing said first bonding material, said second bonding material and said cementitious material to harden.

DESCRIPTION OF THE PREFERRED EMBODIMENTS

Figure 1:
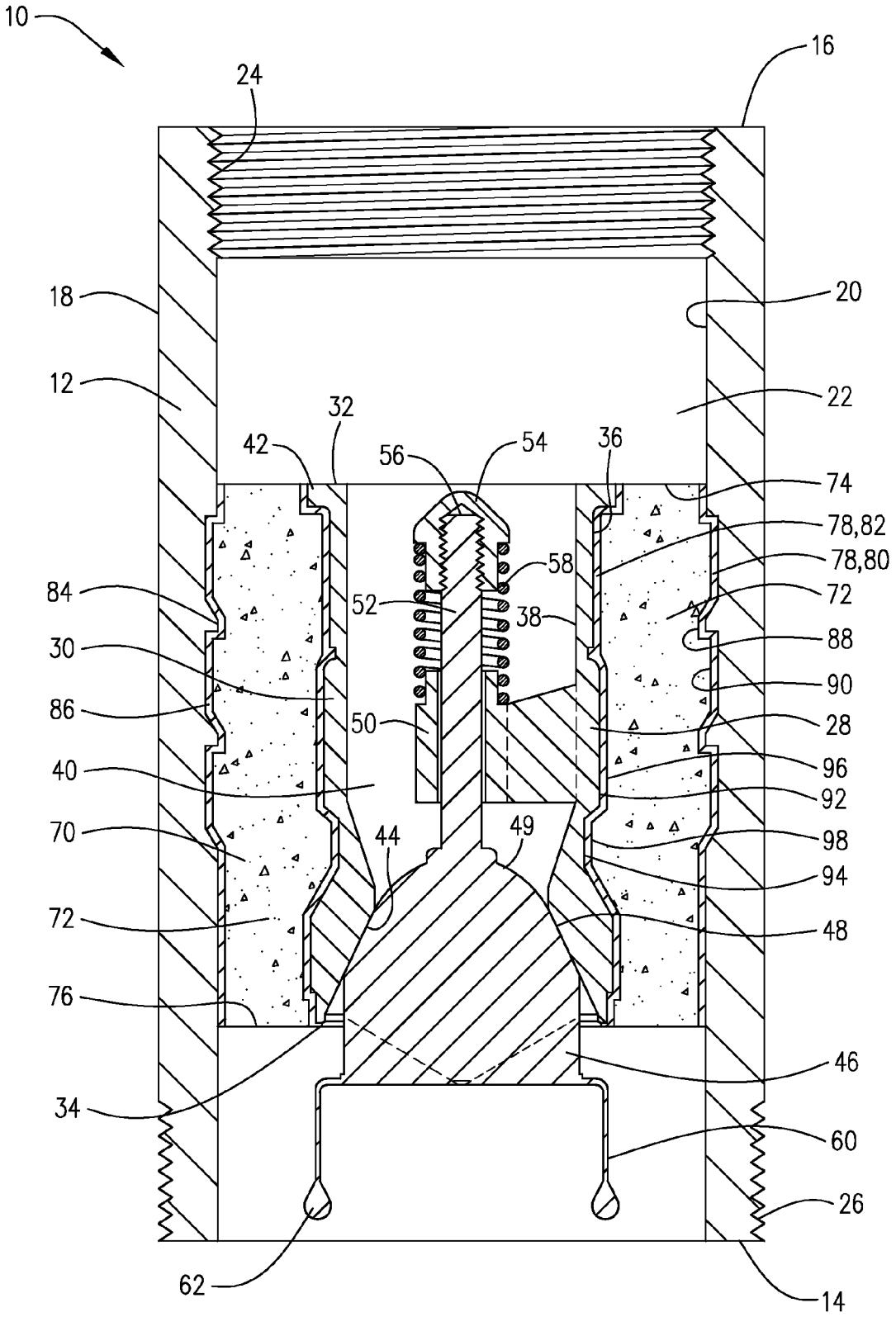
FIG. 1 is a cross-sectional view of a float collar illustrating one embodiment of the invention.

Referring now to the drawings, and more particularly to FIG. 1, the floating apparatus of the present invention is shown and generally designated by the numeral 10. The floating apparatus 10 includes an outer sleeve or outer case 12, which has a lower end 14, an upper end 16, an outer surface 18 and an inner surface 20. Inner surface 20 defines a central flow passage 22. In the embodiment shown in FIG. 1, the floating apparatus 10 is a float collar, which may include an inner thread 24 at its upper end 16, and an outer thread 26 at its lower end 14, thereby configuring the collar to be integrally attached to a casing string thereabove and therebelow. After the float collar is attached to a casing string, the casing string, including the present invention, is lowered into a well. Once the casing string is in place, cement is flowed down and out the lower end of the casing string. The cement fills an annulus between the outer surface of the casing string and the well bore, thus cementing the casing in place.

A valve 28 is disposed in outer case 12. Valve 28 will generally be a check valve. Valve 28 includes a valve housing 30 having an upper end 32, a lower end 34, an exterior surface 36 and an interior surface 38. Interior surface 38 defines a bore 40 extending from upper end 32 to lower end 34. Valve housing 30 may also include a radially outwardly extending lip 42 at its upper end 32. An annulus 70 is defined between valve housing 30 and outer sleeve 12. Annulus 70 is defined by inner surface 20 of outer sleeve 12 and exterior surface 36 of valve housing 30.

A valve seat 44 is defined on interior surface 38. Valve 28 further includes a valve element 46 having a sealing surface 48, which sealingly engages valve seat 44. A lip seal 49 may be defined on sealing surface 48. A valve guide 50 disposed in valve housing 30 slidingly receives a valve stem 52, which extends upwardly (or towards upper end 32) from valve element 46. A valve cap 54 is attached to an upper end 56 of valve stem 52. A valve spring 58 is disposed about valve stem 52 between valve cap 54 and valve guide 50. Valve spring 58 biases valve cap 54 upwardly thereby sealingly engaging valve seat 44 and sealing surface 48 of valve element 46. Valve spring 58 may be in an expanded or relaxed state when sealing surface 48 sealingly engages valve seat 44 but, more typically, will be in a partially compressed state thereby assuring sealing contact. As will be readily seen from FIG. 1, when sealing surface 48 moves downward (or towards lower end 34), valve spring 58 will be further compressed.

The valve 28 may further include an auto-fill strap 60 attached to the valve element 46. Auto-fill strap 60 has a rounded end or bead 62 disposed at each end. Beads 62 may be placed between valve seat 44 and sealing surface 48 prior to lowering the casing string into a well, thereby allowing fluid to flow through the casing and through the floating apparatus 10 as it is lowered into the well. Once the casing is in place, fluid is pumped into the float equipment forcing valve element 46 down and releasing the beads 62. Once fluid flow is stopped, valve spring 58 will urge valve stem 52 upwardly, so that sealing surface 48 of valve element 46 sealingly engages valve seat 44.

Looking again at annulus 70, a cementitious material or cement body portion 72 is disposed in annulus 70. The cement body portion 72 has an upper end 74, which terminates approximately at upper end 32 of valve housing 30, and a lower end 76, which terminates approximately at lower end 34 of valve housing 30. Cementitious material 72 is typically comprised of high compressive strength cement. Such cementitious materials shrink as they cure and this shrinkage creates a micro-annulus between valve housing 30 and the cementitious material 72 and between outer case 12 and cementitious material 72. Such micro-annuluses allow for undesirable fluid flow communication across floating apparatus 10; in other words, such micro-annuluses allow for fluid flow communication other than that controlled by valve 28. Accordingly, well fluid may leak through the micro-annulus and can enter the casing during the well cementing job, thus contaminating the cement and causing a poor cement job. Additionally, once the well cementing job is complete, the valve should operate to keep cement from re-entering the casing; however, the micro-annulus created during curing allows the cement to re-enter the inner diameter of the casing. The cement must then be drilled out of the casing, a process which is time-consuming and costly.

To prevent such difficulties, the current invention incorporates a bonding material 78 between the cementitious material 72 and inner surface 20 of outer sleeve 12 and between the cementitious material 72 and exterior surface 36 of valve housing 30. The bonding material 78 is coated on each surface such that a first portion 80 of bonding material 78 adheres to and encircles at least a portion of said inner surface 20, and a second portion 82 of bonding material 78 adheres to and encircles at least a portion of said exterior surface 36. More specifically, the first portion 80 of bonding material 78 should coat at least a portion of inner surface 20 forming the annulus 70 and the second portion 82 of the bonding material 78 should coat at least a portion of exterior surface 36 forming the annulus 70. More preferably, the entire inner surface 20 forming the annulus 70 and the entire exterior surface 36 forming the annulus is coated with the bonding material 78. While generally first portion 80 and second portion 82 of bonding material 78 are the same bonding material, it is within the scope of the invention for first portion 80 and second portion 82 to be different bonding materials as long as they are both selected from the bonding materials described below.

The bonding material 78 suitable for use in the invention are water-compatible resins that are cured to a hard, consolidated mass. Generally, the water-compatible resin is a water-compatible resin having a low cure temperature (less than 250° F.). The resin should be water compatible to insure a strong bond or strong adhesion between the cementitious material and the bonding material to, thus, provide a bond of adequate strength to resist shear stress and of adequate strength and resilience to resist forming micro-annulus as the cementitious material shrinks during curing of the cementitious material. Suitable water-compatible resins can be selected from one or more water-compatible resins from the group consisting of: two component epoxy based resins, novolak resins, polyepoxide resins, phenolaldehyde resins, urea-aldehyde resins, urethane resins, phenolic resins, furan resins, furan/furfuryl alcohol resins, phenolic/latex resins, phenol formaldehyde resins, polyester resins and hybrids and copolymers thereof, polyurethane resins and hybrids and copolymers thereof, acrylate resins, and mixtures thereof. Some suitable resins, such as epoxy resins, may be cured with an internal catalyst or activator so that they may be cured using only time and temperature. Other suitable resins, such as furan resins generally require a time-delayed catalyst or an external catalyst to help activate the polymerization of the resins if the cure temperature is low (i.e., less than 250° degree. F.), but will cure under the effect of time and temperature if a temperature above about 250° F. is used, preferably above about 300° F. However, lower cure temperatures are preferred as higher cure temperatures may adversely affect the curing of the cementitious material. It is within the ability of one skilled in the art, with the benefit of this disclosure, to select a suitable resin for use in embodiments of the present invention and to determine whether a catalyst is required to trigger curing.

Prior to the bonding material curing (also called hardening), the cementitious material is added to annulus 70. The cementitious material is added as a slurry and cures to a dry hard cementitious material or cement body 72. Thus, as the bonding material and cementitious material each cure, they will bond directly together creating a high strength resilient bond. In the current invention, it is preferred that the bonding material is bonded or adhered directly to the cementitious material without the use of aggregates or other particles embedded in the bonding material or, in other words, it is preferred that the bonding material be aggregate free. Additionally, the bonding material will bond to inner surface 20 or exterior surface 36, as applicable. Thus, the cementitious material is bonded to the outer sleeve or valve housing by its bond to the bonding material and the resilient bond of the bonding material is able to expand as the cementitious material shrinks, thus, preventing micro-annuluses.

To further support the cementitious material 72 within annulus 70, inner surface 20 of outer sleeve 12 has annular rim 84 and annular groove 86, preferably and as shown there are a plurality of such rims and grooves. As the cementitious material cures, it will cure to form annular groove 88 and annular rim 90, which mate with annular rim 84 and annular groove 86, respectively. Additionally, exterior surface 36 of valve housing 30 has an annular rim 92 and annular groove 94 and can have a plurality of such rims and grooves. As the cementitious material cures, it will cure to form annular groove 96 and annular rim 98, which mate with annular rim 92 and annular groove 94, respectively. The afore described mating grooves and rims provide mechanical retention of the cement body against stress that could dislodge it, such as shear stress along the longitudinal axis of annulus 70 that occur during downhole use of floating apparatus 10. The bonding agent provides reinforcement to enhance not only hydraulic retention (prevent hydraulic flow through the annulus 70) but also enhance mechanical retention.

Figure 2:
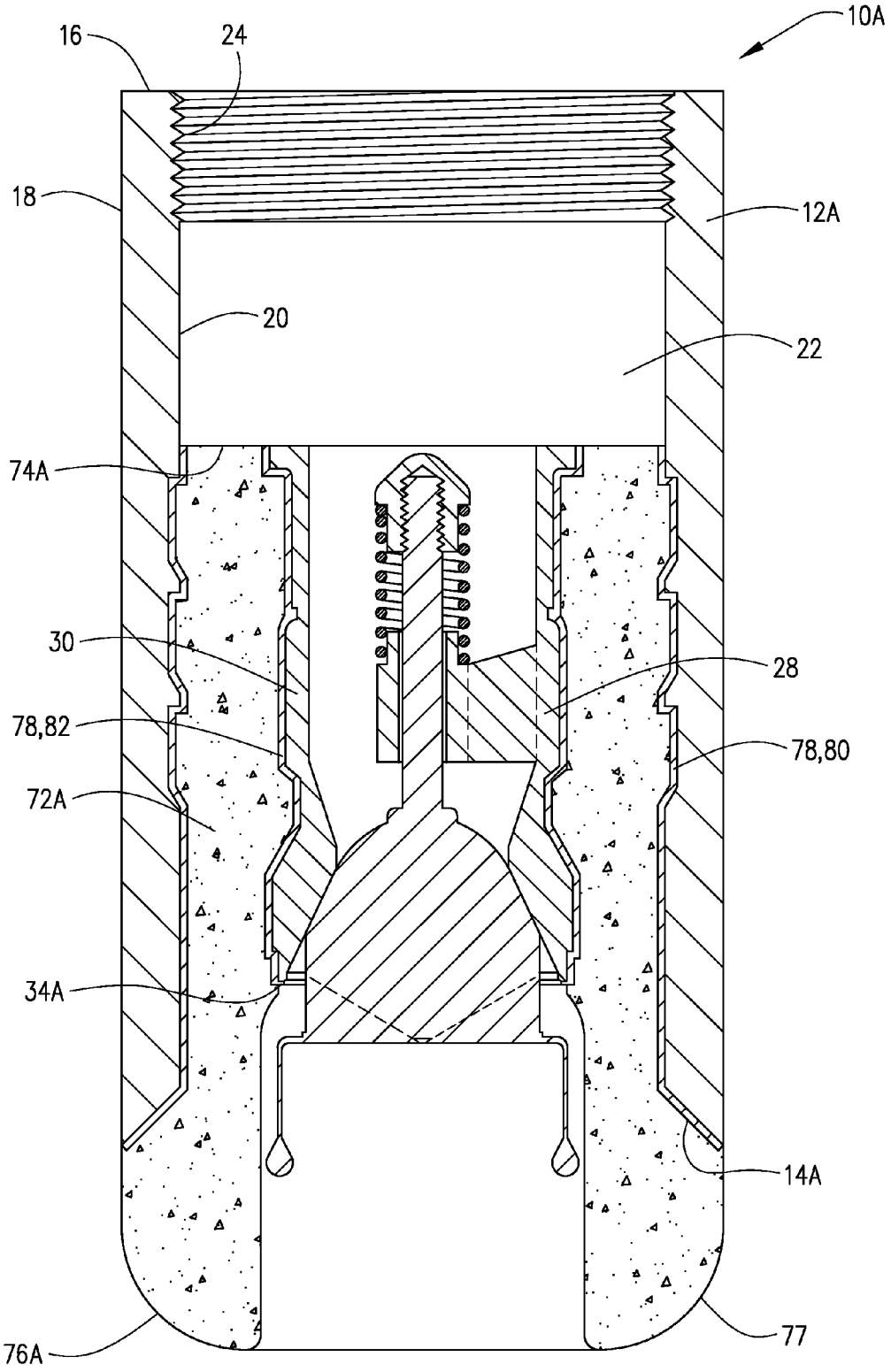
FIG. 2 is a cross-sectional view of a float shoe illustrating another embodiment of the invention.

An alternative embodiment of the invention is shown in FIG. 2. The embodiment shown in FIG. 2 is generally designated by the numeral 10A. The features that are similar to those shown in FIG. 1 but have been modified are generally designated by the suffix A. The remaining features are substantially identical to the features of the embodiment shown in FIG. 1.

In the embodiment shown in FIG. 2, the floating equipment is a float shoe generally designated by the numeral 10A. The float shoe is similar to and includes many of the same features as the float collar, but is designed to be lowered into the hole ahead of the casing string. Float shoe 10A has an outer sleeve or outer case 12A, which has an upper end 16 and a lower end 14A. Upper end 16 includes a thread 24 so that it may be connected to a string of casing thereabove. Lower end 14A, however, does not include a thread. Float shoe 10A includes a cementitious material 72A having an upper end 74A and a lower end 76A, which extends below lower end 34 of valve housing 30 and below lower end 14A of outer case 12A. Lower end 76A forms a guide surface 77.

The method of fabricating the substantially leakproof floating equipment comprises providing an outer sleeve or case, and radially centrally positioning the valve housing in the outer sleeve, thereby defining an annulus between the valve housing and the outer sleeve. Prior to or after insertion of the valve, the inside surface of the outer sleeve is coated with a bonding material. Additionally, prior to or after insertion of the valve, the exterior surface of the valve housing is coated with a bonding material. Generally, the bonding material is the same for each application but could, if desired, be different for the two surfaces. The bonding material will generally be applied in a layer from 1 nm to 5 mm in thickness and will be aggregate free. Prior to curing of the bonding material, the annulus between the outer sleeve and the valve housing is then filled with a slurry of cementitious material to form a cement body portion. In order to retain the slurry of cementitious material in the annulus during curing, a removable mold may be used, as is known in the art. After introduction of the cementitious material, the bond material and cementitious material are allowed to cure prior to use of the tool. The curing will take place to adhere the cementitious material directly to the bonding material without use of aggregates or other similar particles acting as an interlocking agent. Additionally, the cementitious material will cure to form a hardened cement body portion that blocks fluid flow through the annulus created by outer sleeve 12 and valve housing 30.

The presence of the resin will increase the shear strength between the cement and the other components. The increased bonding strength will prevent the cement from cracking or debonding when the float equipment is subjected to elevated temperatures and differential pressures while in use. Further, the improved and resilient bond created between the cementitious material and the bonding material improves hydraulic sealing capabilities. The resilient bond prevents the formation of micro-annuluses that would allow fluid to flow through the annulus created between the outer sleeve and valve housing. Thus, a reliable hydraulic seal between the valve and outer case that is more easily fabricated and assembled compared to conventional technology is provided by the current invention.

In operation, the float apparatus is first constructed according to the above method. After the bonding material and cementitious material are fully hardened, the float apparatus is attached to a casing string. The casing string is then lowered into a well. While the casing string is lowered, bead 62 may be between valve seat 44 and sealing surface 48, thereby allowing fluid to flow through the casing and through floating apparatus 10, thus facilitating the lowering of the casing string into the well by reducing upward force on the casing string caused by fluid pressure in the well. Because annulus 70 has been blocked by cement body portion 72 and because bonding material 78 ensures there are not micro-annuluses formed, there is no flow of well fluid through annulus 70. Once the casing string is in place, fluid is pumped into the float equipment forcing valve element 46 down and releasing beads 62. When the fluid flow is stopped, spring 58 will urge valve stem 52 upwardly, so that sealing element 48 of valve element 46 sealingly engages valve seat 44. Thus, further flow of fluid upward through valve 28 is prevented. At this point, cement is flowed down and out the lower end of the casing string. The cement fills an annulus between the outer surface of the casing string and the wellbore, thus cementing the casing in place. Next a displacement fluid is pumped down the casing string to move all the cement through valve 28 and into the annulus between the outer surface of the casing string and the wellbore. After displacement operations are completed, the casing is filled with displacement fluid and cement is located in the annular space between the casing and the wellbore, at which point, the surface pressure is released and valve 28 holds the cement in place by creating a barrier for holding differential pressure. During the described well-cementing operation, cement body portion 72 in cooperation with bonding material 78 prevents upward flow of fluid through annulus 70 with the resilient bond supplied by bonding material 78 ensuring hydraulic retention and enhancing mechanical retention.

In the above description terms such as up, down, lower, upper, upwards, downwards and similar terms have been used to describe the placement or movement of elements. It should be understood that these terms are used in accordance with the typical orientation of a casing string; however, the invention is not limited to use in such an orientation but is applicable to use with other orientations. Also, it will be seen, therefore, that the floating apparatus of the present invention and method of fabricating such an apparatus are well adapted to carry out the ends and advantages mentioned as well as those inherent therein. While the presently preferred embodiment of the invention has been shown for the purposes of this disclosure, numerous changes in the arrangement and construction of parts may be made by those skilled in the art. All such changes are encompassed within the scope and spirit of the dependent claims.

What is claimed is:

1. A floating apparatus for use in a well casing comprising:

an outer sleeve configured to be connected to said well casing, said outer sleeve having an outer surface and an inner surface, wherein said inner surface defines a central flow passage;

a valve disposed in said outer sleeve, said valve comprising a valve housing having an interior surface defining a bore in fluid flow communication with said central flow passage and an exterior surface opposing said inner surface of said outer sleeve wherein said exterior surface and inner surface define an annulus between said valve housing and said outer sleeve;

a first bonding material adhered to and encircling at least a portion of said inner surface of said outer sleeve located in said annulus;

a second bonding material adhered to and encircling at least a portion of said exterior surface of said valve housing located in said annulus; and a cementitious material having a first surface and a second surface; said cementitious material being disposed in said annulus so that said cementitious material prevents flow through said annulus, wherein said first surface is bonded to said first bonding material and said second surface is bonded to said second bonding material by introducing said cementitious material into said annulus prior to said first bonding material and said second bonding material hardening such that said first bonding material and said cementitious material cure together at said first surface to form a first bond and such that said second bonding material and said cementitious material cure together at said second surface to form a second bond.

2. The apparatus of claim 1 wherein said valve further comprises:

a valve seat defined on said valve housing;

a valve guide disposed in said central opening of said valve housing; a valve element having a sealing surface sealingly engageable with said valve seat; and a valve stem extending from said valve element and slidably received through said valve guide.

3. The apparatus of claim 1 wherein said first bonding material and said second bonding material each comprise a water-compatible resin that is cured to a hard, consolidated mass.

4. The apparatus of claim 3 wherein said first bonding material and said second bonding material are aggregate free.

5. The apparatus of claim 4 wherein said water-compatible resin is selected from water-compatible resins in the group consisting of: two component epoxy based resins, novolak resins, polyepoxide resins, phenolaldehyde resins, urea-aldehyde resins, urethane resins, phenolic resins, furan resins, furan/furfuryl alcohol resins, phenolic/latex resins, phenol formaldehyde resins, polyester resins and hybrids and copolymers thereof, polyurethane resins and hybrids and copolymers thereof, acrylate resins, and mixtures thereof.

6. The apparatus of claim 5 wherein said first bonding material and said second bonding material each comprise the same water compatible resin.

7. The apparatus of claim 1 wherein said inner surface of said outer sleeve has an annular groove and an annular rim which mate with a rim and a groove on said first surface of said cementitious material.

8. The apparatus of claim 1 wherein said exterior surface of said valve housing has an annular groove and an annular rim which mate with a rim and a groove on said second surface of said cementitious material.

9. A floating apparatus for use in a well casing comprising:

an outer sleeve configured to be connected to said well casing, said outer sleeve having an outer surface and an inner surface, wherein said inner surface defines a central flow passage;

a valve disposed in said outer sleeve, said valve comprising a valve housing having an interior surface defining a bore in fluid flow communication with said central flow passage and an exterior surface opposing said inner surface of said outer sleeve wherein said exterior surface and inner surface define an annulus between said valve housing and said outer sleeve;

a first bonding material adhered to and encircling at least a portion of said inner surface of said outer sleeve located in said annulus;

a second bonding material adhered to and encircling at least a portion of said exterior surface of said valve housing located in said annulus; and a cementitious material having a first surface and a second surface; said cementitious material being disposed in said annulus so that said cementitious material prevents flow through said annulus, wherein said first surface is bonded to said first bonding material and said second surface is bonded to said second bonding material so that said cementitious material prevents flow through said annulus; and wherein said first bonding material and said second bonding material are aggregate free.

10. A floating apparatus for use in a well casing comprising:

an outer sleeve configured to be connected to said well casing, said outer sleeve having an outer surface and an inner surface, wherein said inner surface defines a central flow passage and has a first annular groove and a first annular rim;

a valve disposed in said outer sleeve, said valve comprising:

a valve housing having an interior surface defining a bore in fluid flow communication with said central flow passage and an exterior surface opposing said inner surface of said outer sleeve wherein said exterior surface and inner surface define an annulus between said valve housing and said outer sleeve and wherein said exterior surface has a second annular groove and a second annular rim;

a valve seat defined on said valve housing;

a valve guide disposed in said central opening of said valve housing; a valve element having a sealing surface sealingly engageable with said valve seat; and a valve stem extending from said valve element and slidably received through said valve guide;

a bonding material having a first portion adhered to and encircling at least a portion of said inner surface of said outer sleeve located in said annulus and a second portion adhered to and encircling at least a portion of said exterior surface of said valve housing located in said annulus, wherein said bonding material is aggregate free and comprises a water-compatible resin cured to a hard, consolidated mass, said water-compatible resin selected from water-compatible resins in the group consisting of: two component epoxy based resins, novolak resins, polyepoxide resins, phenolaldehyde resins, urea-aldehyde resins, urethane resins, phenolic resins, furan resins, furan/furfuryl alcohol resins, phenolic/latex resins, phenol formaldehyde resins, polyester resins and hybrids and copolymers thereof, polyurethane resins and hybrids and copolymers thereof, acrylate resins, and mixtures thereof; and a cementitious material having a first surface having an outer groove and an outer rim and a second surface having an inner groove and inner rim, said cementitious material being disposed in said annulus with said outer groove and outer rim mated with said first annular rim and said first annular groove of said inner surface and said inner groove and inner rim mated with said second annular rim and said second annular groove of said exterior surface and with said first surface being bonded to said first portion of said bonding material and said second surface being bonded to said second portion of said bonding material so that said cementitious material prevents flow through said annulus.

11. A method of fabricating substantially leak-proof floating equipment comprising:

placing a valve inside an outer sleeve, said valve having a housing having an exterior surface and said outer sleeve having an inner surface, said inner surface defining a central flow passage, and said exterior surface of said housing and inner surface of said outer sleeve defining an annulus;

coating said exterior surface of said housing with a first bonding material and said inner surface of said outer sleeve with a second bonding material wherein said coating occurs at least along the portions of said inner surface and said outer surface defining said annulus and wherein said first bonding material and said second bonding material harden after said coating;

placing a cementitious material in said annulus prior to said first bonding material and said second bonding material hardening; and allowing said first bonding material, said second bonding material and said cementitious material to harden.

12. The method of claim 11 wherein said first bonding material and said second bonding material each comprise a water-compatible resin that is curable to a hard, consolidated mass.

13. The method of claim 12 wherein said first bonding material and said second bonding material are aggregate free.

14. The method of claim 13 wherein said water-compatible resin is selected from water-compatible resins in the group consisting of: two component epoxy based resins, novolak resins, polyepoxide resins, phenolaldehyde resins, urea-aldehyde resins, urethane resins, phenolic resins, furan resins, furan/furfuryl alcohol resins, phenolic/latex resins, phenol formaldehyde resins, polyester resins and hybrids and copolymers thereof, polyurethane resins and hybrids and copolymers thereof, acrylate resins, and mixtures thereof.

15. The method of claim 14 wherein said first bonding material and said second bonding material both comprise the same water-compatible resin.

16. The method of claim 11 wherein the method is carried out without the introduction of aggregate between said first bonding material and said cementitious material and without the introduction of aggregate between said second bonding material and said cementitious material.

17. A method of fabricating substantially leak-proof floating equipment comprising:

placing a valve inside an outer sleeve, said valve having a housing having an exterior surface and said outer sleeve having an inner surface, said inner surface defining a central flow passage, and said exterior surface of said housing and inner surface of said outer sleeve defining an annulus;

coating said exterior surface of said housing with a first portion of a bonding material and said inner surface of said outer sleeve with a second portion of said bonding material wherein said coating occurs at least along the portions of said inner surface and said outer surface defining said annulus and wherein said bonding material hardens after said coating and wherein said bonding material is aggregate free and comprises a water-compatible resin that is curable to a hard consolidated mass, and said water-compatible resin is selected from water-compatible resins in the group consisting of: two component epoxy based resins, novolak resins, polyepoxide resins, phenolaldehyde resins, urea-aldehyde resins, urethane resins, phenolic resins, furan resins, furan/furfuryl alcohol resins, phenolic/latex resins, phenol formaldehyde resins, polyester resins and hybrids and copolymers thereof, polyurethane resins and hybrids and copolymers thereof, acrylate resins, and mixtures thereof;

placing a cementitious material in said annulus prior to said bonding material hardening; and allowing said bonding material and said cementitious material to harden, wherein the above steps are carried out without the introduction of aggregate between said bonding material and said cementitious material.

* * * * *